US010989495B2

(12) United States Patent
Baskins

(10) Patent No.: US 10,989,495 B2
(45) Date of Patent: Apr. 27, 2021

(54) FIREARM HARNESS SYSTEM AND METHOD

(71) Applicant: Daniel Jay Baskins, Wynne, AR (US)

(72) Inventor: Daniel Jay Baskins, Wynne, AR (US)

( * ) Notice: Subject to any disclaimer, the term of this patent is extended or adjusted under 35 U.S.C. 154(b) by 0 days.

(21) Appl. No.: 16/530,781

(22) Filed: Aug. 2, 2019

(65) Prior Publication Data

US 2020/0124378 A1 Apr. 23, 2020

Related U.S. Application Data

(60) Provisional application No. 62/714,733, filed on Aug. 5, 2018.

(51) Int. Cl.
*F41C 33/04* (2006.01)
*A45F 3/14* (2006.01)

(52) U.S. Cl.
CPC ..... *F41C 33/046* (2013.01); *A45F 3/14* (2013.01); *A45F 2200/0591* (2013.01)

(58) Field of Classification Search
CPC .. Y10S 224/913; F41C 33/005; F41C 33/003; F41C 23/14; F41C 33/007; F41C 33/002; F41C 33/001
See application file for complete search history.

(56) References Cited

U.S. PATENT DOCUMENTS 2,078,010 A * 4/1937 Meepos ..... F41C 23/02 42/85
2,576,559 A * 11/1951 Bennek ..... F41C 33/003 224/149
2,647,667 A * 8/1953 Brown ..... F41C 33/005 224/149
2,771,699 A * 11/1956 Herter ..... F41C 23/02 42/85
2,830,747 A * 4/1958 Creste ..... F41C 23/02 224/150
3,700,147 A * 10/1972 Vaughn ..... F41C 33/005 224/149
3,869,074 A * 3/1975 Roach ..... F41C 33/005 224/149
5,092,505 A * 3/1992 Olschlager ..... F41C 23/02 224/149
5,279,060 A * 1/1994 Watson ..... F41C 23/02 42/85
5,575,411 A * 11/1996 Hightower ..... F41C 23/02 224/149

(Continued)

*Primary Examiner* — Brian D Nash

(74) *Attorney, Agent, or Firm* — Robert C. Corbett

(57) ABSTRACT

A system for supporting a firearm in a generally vertical position includes a stock support member to support the stock of the firearm, a first fastening element operatively connectable to a user, and a second fastening element mounted with respect to the firearm. The system is configured such that the first and second fastening elements remain engaged when the firearm is in the generally vertical position so that the firearm is supported only by the fastening elements and the stock support member, but automatically disengage when the firearm is moved to a generally horizontal position for firing. A method includes connecting the first fastening element to a human user via a flexible harness and moving the firearm from the first position to the second position.

8 Claims, 4 Drawing Sheets

(56) References Cited

U.S. PATENT DOCUMENTS 5,735,496 A * 4/1998 Dube ..... F41A 23/02 248/118
5,802,756 A * 9/1998 Hightower ..... F41C 33/002 42/85
6,112,448 A * 9/2000 Gray ..... F41C 33/001 42/85
6,152,338 A * 11/2000 Smith ..... A01K 97/10 224/149
6,354,034 B1 * 3/2002 Norris, Sr. ..... F41C 23/02 42/85
6,520,390 B2 * 2/2003 Verdugo ..... F41C 33/001 224/149
7,082,709 B2 * 8/2006 Lindsey ..... F41C 33/001 42/85
7,654,027 B1 * 2/2010 Grover ..... F16B 21/165 24/573.11
D639,890 S * 6/2011 Troy, Jr. ..... D22/108
8,166,694 B2 * 5/2012 Swan ..... F41C 33/007 224/198
8,516,732 B2 * 8/2013 Burnsed, Jr. ..... F41C 23/02 24/573.11
8,650,794 B2 * 2/2014 Swan ..... F41C 33/007 42/106
9,587,908 B2 * 3/2017 Bjelde ..... F41C 33/007
10,209,031 B2 * 2/2019 Lance ..... F41C 23/02
10,466,011 B2 * 11/2019 Swan ..... A45F 5/021
2005/0092790 A1 * 5/2005 Guarniere ..... F41C 33/005 224/149
2007/0023467 A1 * 2/2007 Spreer ..... F41C 33/046 224/149
2011/0290844 A1 * 12/2011 Hoffman ..... A45F 3/14 224/645
2014/0190054 A1 * 7/2014 Ascano ..... F41C 33/007 42/71.01

* cited by examiner

FIREARM HARNESS SYSTEM AND METHOD

CROSS REFERENCE TO RELATED APPLICATION

This application claims the benefit of U.S. provisional patent application No. 62/714,733, filed Aug. 5, 2018, and which is hereby incorporated by reference in its entirety.

TECHNICAL FIELD

This disclosure relates to harnesses for carrying or supporting firearms.

BACKGROUND OF THE INVENTION

Shotguns and rifles ("long guns") are often difficult to hold and require two hands to carry. Prior art attempts to facilitate the handling and carrying of long guns include shoulder straps, which enable the long gun to be supported on the shoulder of a user. However, shoulder straps typically place the gun in a vertical position behind the user, and therefore require significant time and motion to move the gun from the carrying position to the use or firing position, which is in front of the user in a horizontal orientation. Furthermore, the strap may become entangled in the arm of the user, thus requiring more time and effort to move the gun from the carrying position to the use position.

SUMMARY

A harness system permits hands-free holding of a firearm. The harness system improves upon the prior art by safely and securely carrying the firearm in front of the user, thereby reducing the time and movement necessary to bring the firearm to a firing position. The invention also includes a latch that automatically releases the firearm from the harness system when it is moved to its firing position, thereby minimizing or eliminating any interference with the use of the firearm. A corresponding method of use is provided.

DETAILED DESCRIPTION

Figure 1:
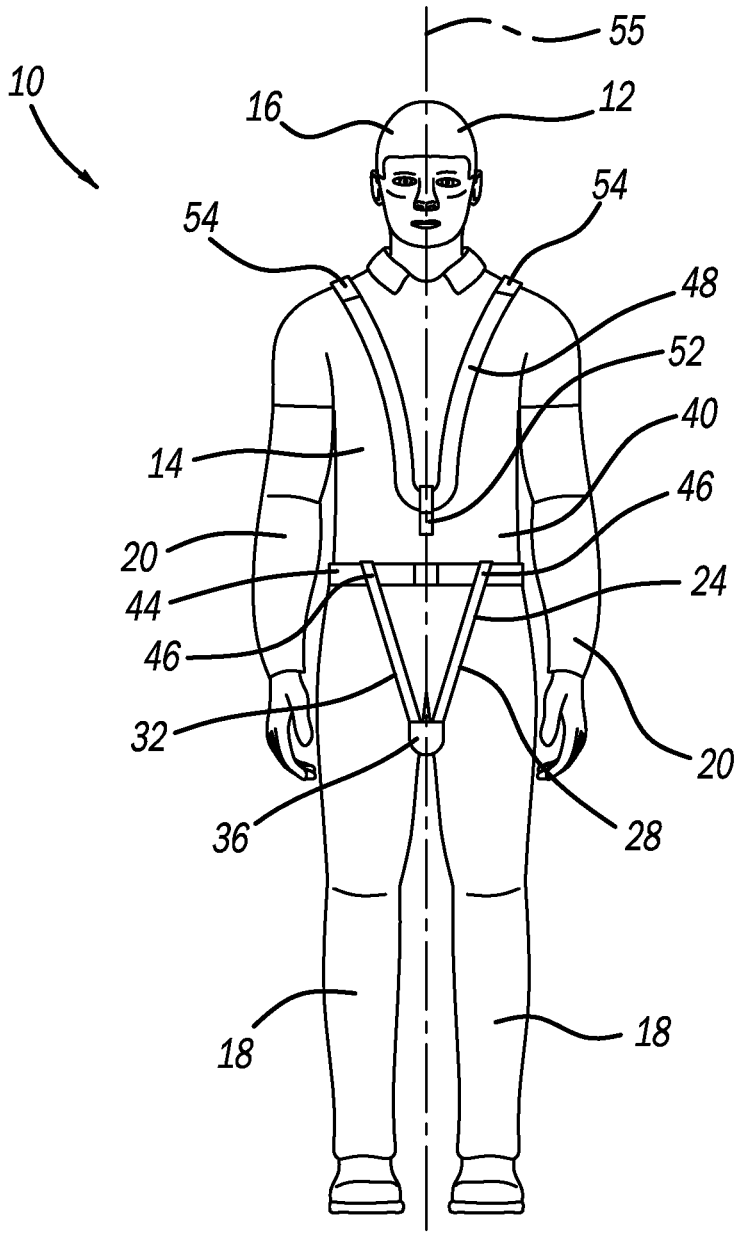
FIG. 1 is a schematic, front view of a harness system operatively connected to a human.

Referring to FIG. 1, a firearm harness system 10 is schematically depicted. The system 10 is operatively connected to a human user 12. As understood by those skilled in the art, the user 12 includes a torso 14. The user 12 also includes a head 16 extending upwardly from the torso 14, two legs 18 extending downwardly from the torso 14, and two arms 20 extending laterally from the torso 14. The harness system 10 includes a firearm stock support assembly 24. In the embodiment depicted, the firearm stock support assembly 24 includes two flexible straps 28, 32 that are connected to a stock support member 36. Each strap 28, 32 is mountable with respect to the user 12 such that the stock support member 36 is suspended by the straps 28, 32 at or below the waist 40 of the human 12. In the embodiment depicted, the stock support member 36 is slightly below the level at which the legs 18 connect to the torso 14.

The stock support assembly 24 depicted is configured for attachment to a belt 44 that is secured to the human 12 at or adjacent to the waist 40. For example, each strap 28, 32 may define a respective loop 46 through which the belt 44 extends, thereby securing each strap 28, 32 to the belt 44 and, correspondingly, to the human 12. The stock support member 36 is attached to the ends of the straps 28, 32 such that it is suspended from the straps 28, 32 at or below the waist 40. The straps 28, 32 may have buckles (not shown) or other systems by which the length of the straps 28, 32 can be adjusted and thereby selectively vary the height at which the stock support member 36 is suspended.

The system 10 also includes a flexible harness member 48 that is operatively connected to the user 12 and that has a first fastening element 52 mounted thereto. The flexible harness member 48 is mounted with respect to the user 12 such that the first fastening element 52 is suspended at a level between the head 16 and the legs 18. In one embodiment, the harness member 48 has two clips 54, each of which is attached to a respective end of the harness member 48. Each clip 54 may then be attached to an article of clothing worn by the user, or another harness (not shown) that is worn by the user around or near the user's chest or shoulders. In another embodiment, the harness member 48 forms a loop through which the neck of the user extends. The harness system 10 is configured such that the stock support member 36 and the first fastening element 52 fall along the plane of symmetry 55 of the human 12.

Figure 2:
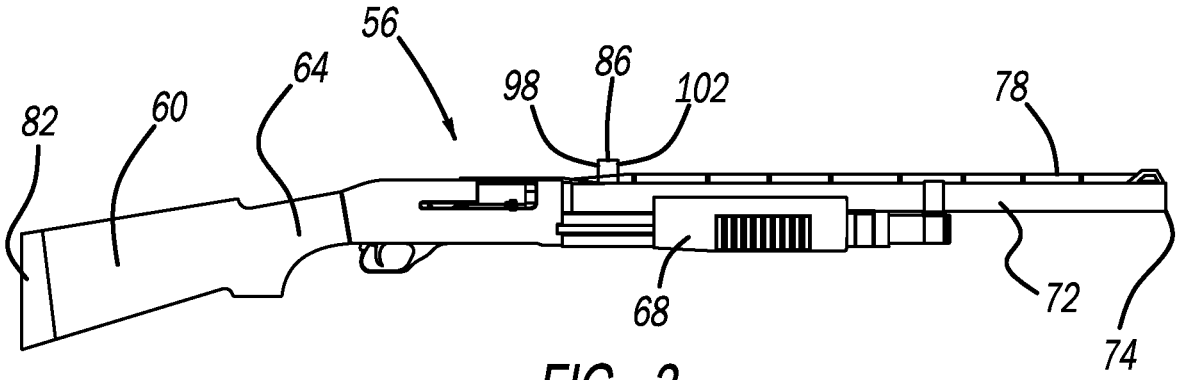
FIG. 2 is a schematic, side view of a firearm usable with the harness system of FIG. 1.

The system 10 enables hands-free carrying or holding of a firearm by the user 12. Referring to FIG. 2, a firearm 56 is schematically depicted. As understood by those skilled in the art, the firearm 56 includes a stock 60, a grip 64, a fore-end 68, and a barrel 72. The barrel 72 terminates at muzzle 74. A rib 78 is attached to, and runs parallel to, the barrel 72. The firearm 56 in the embodiment depicted includes a butt 82 or recoil pad attached to the end of the stock 60. As used herein, "stock" includes any butt or recoil pad attached to the stock. The firearm 56 depicted is a shotgun, and is merely one example of a firearm that may be employed within the scope of the claimed invention. For example, rifles may also be employed within the scope of the disclosure.

Figure 3:
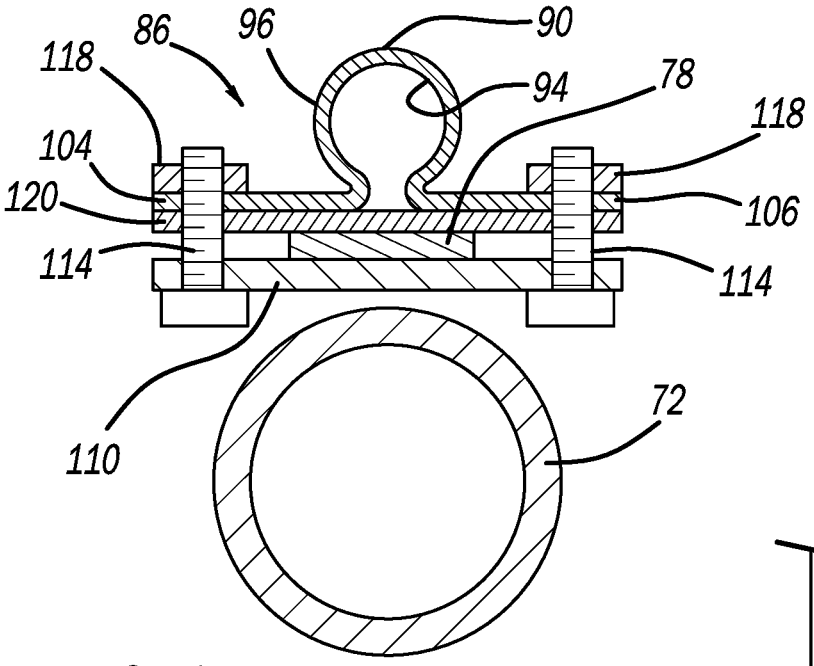
FIG. 3 is a schematic, cross-sectional front view of a fastening element mounted to the firearm of FIG. 2.
Figure 4:
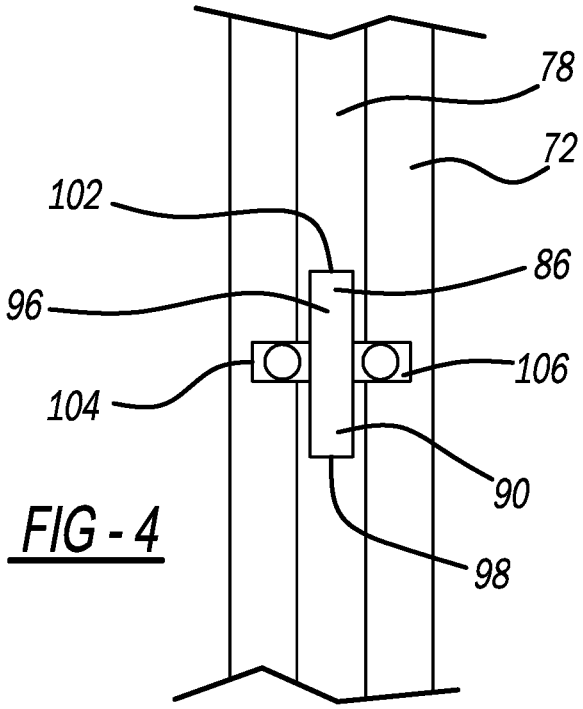
FIG. 4 is a schematic, top view of the fastening element of FIG. 3 mounted to the firearm of FIG. 2.

Referring to FIGS. 2-4, wherein like reference numbers refer to like components throughout, a second fastening element 86 is mounted to the firearm 56. The second fastening element 86 includes a first member 90 that defines a hole 94. More specifically, the member 90 includes a portion 96 that is a segment of a hollow cylinder, i.e., the portion of a hollow cylinder cut by a plane that is parallel to the cylinder's axis of symmetry. Accordingly, the portion 96 defines a curved surface that defines the hole 94 and that is arc-shaped in cross-section, as best seen in FIG. 3. Accordingly, hole 94 is approximately cylindrical and extends through member 90 so that it is open at two ends 98, 102 of the member 90. End 98 faces rearward, i.e., generally toward the stock 60, and end 102 faces forward, i.e., generally toward the muzzle 74.

In the embodiment depicted, the second fastening element 86 is mounted to the rib 78. More specifically, the first member 90 also includes two flanges 104, 106 that extend from respective sides of portion 96. Each flange 104, 106 defines a respective hole. The second fastening element 86 includes a second member 110 that defines two holes. The second fastening element 86 is fastened to the firearm 56 by placing the second member 110 between the barrel 72 and the rib 78, and then connecting the first member 90 to the second member 110. In the embodiment depicted, the first member 90 and the second member 110 are connected to each other by two threaded fasteners 114, each of which extends through a respective hole in a respective flange 104, 106 and a respective hole in the second member 110.

A nut 118 is applied to each of the fasteners 114 as understood by those skilled in the art. In the embodiment depicted, a third member 120 is inserted between the first member 90 and the rib 78 to function as a spacer. It should be noted that other techniques for connecting the second fastening element 86 to the firearm may be employed within the scope of the disclosure. Similarly, the second fastening element 86 may be integrally formed with the firearm 56 or a component thereof. For example, the rib 78 or the barrel 70 may define the hole 94 and thereby form the second fastening element 86.

Figure 5:
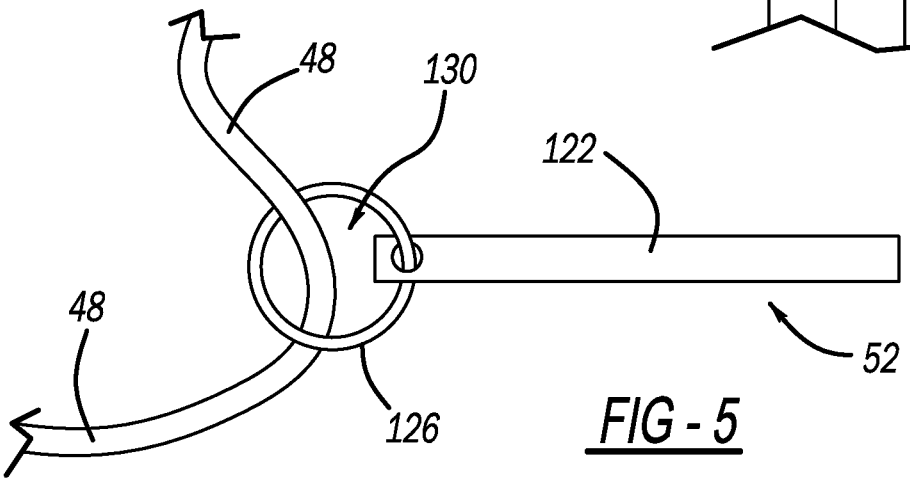
FIG. 5 is a schematic side view of another fastening element mounted to the harness system of FIG. 1.

FIG. 5, wherein like reference numbers refer to like components from FIGS. 1-4, depicts the first fastening element 52. Referring to FIG. 5, the first fastening element 52 is a cylindrical pin or rod 122 having a diameter that is slightly smaller than the diameter of the hole (shown at 94 in FIG. 3) in the second fastening element (shown at 86 in FIGS. 2-4). The rod 122 is attached to the harness member 48 such that the rod 122 is selectively movable along at least a portion of the length of the harness member 48. In the embodiment depicted, a ring 126 is mounted to the rod 122 and defines a hole 130. The harness member 48 extends through the hole 130, as shown in FIG. 5.

Figure 6:
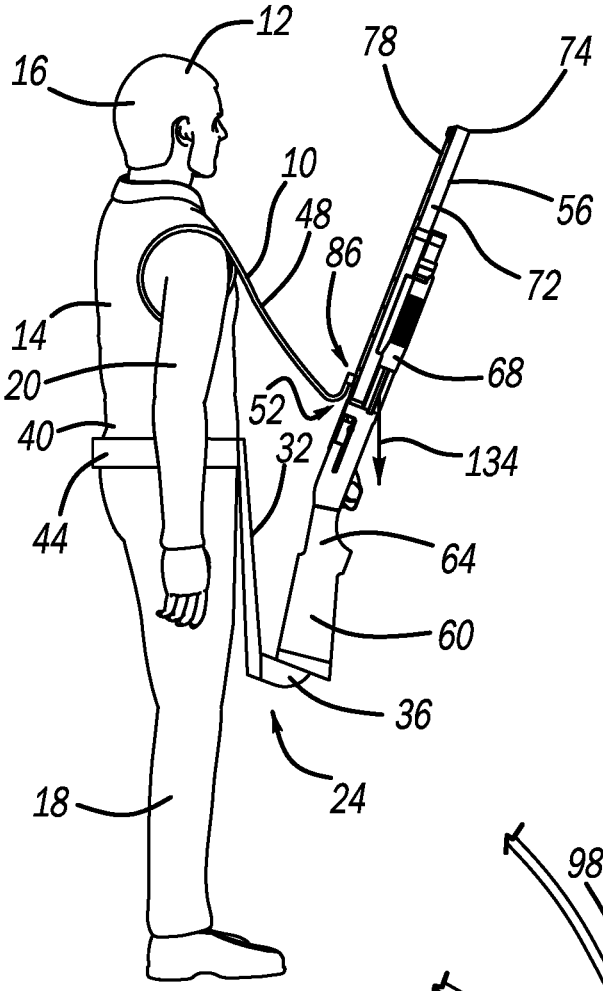
FIG. 6 is a schematic side view of the harness system of FIG. 1 supporting the firearm of FIG. 2 in a carrying position.
Figure 7:
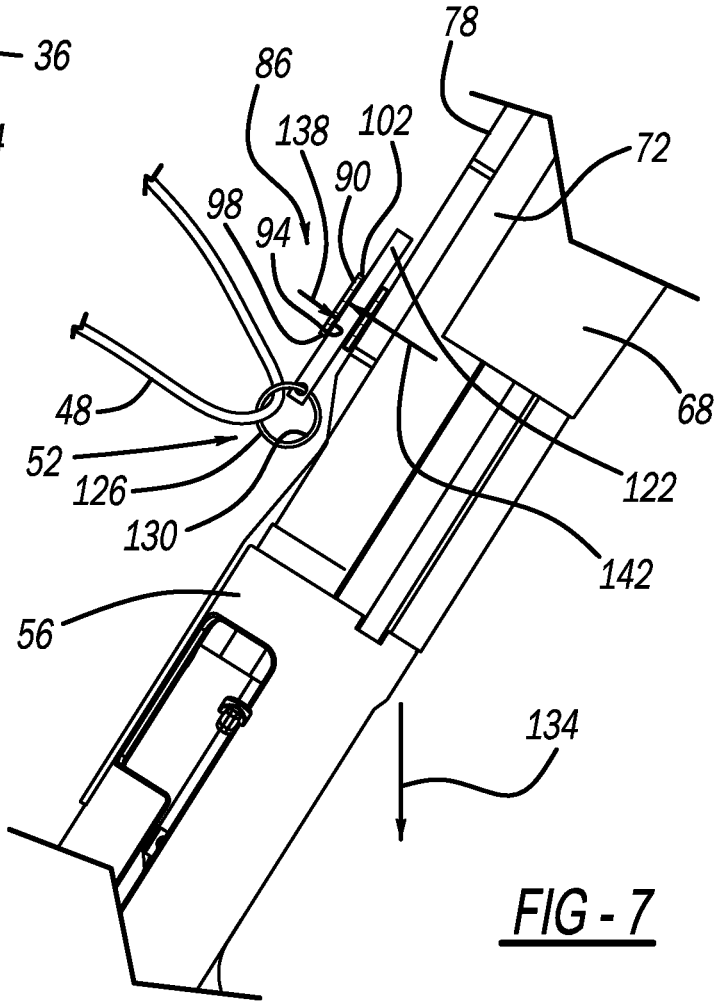
FIG. 7 is a schematic, partial cut-away perspective view of the fastening element of FIGS. 3 and 4 engaged with the fastening element of FIG. 5 while the firearm is supported by the harness system in the carrying position.
Figure 8:
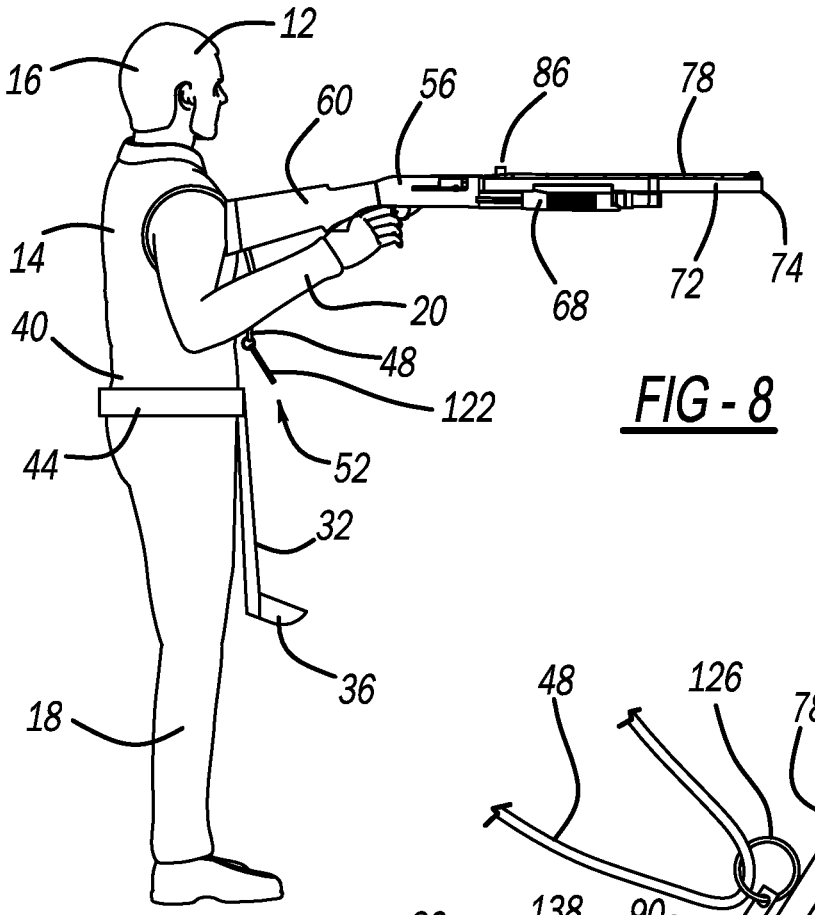
FIG. 8 is a schematic side view of the harness system disengaged from the firearm in its firing position.

The harness system 10 permits hands-free holding of the firearm 56. The system 10 improves upon the prior art by safely and securely carrying the firearm 56 in front of the user 12, thereby reducing the time and movement necessary to bring the firearm 56 to a firing position. FIGS. 6-8 schematically depicted a method of using the harness system 10.

Referring to FIGS. 6 and 7, wherein like reference numbers refer to like components from FIGS. 1-5, the method of use includes operatively connecting the stock support member 36 to the human 12 such that the stock support member 36 is disposed at or below the waist 40 of the human 12. In the embodiment depicted, the stock support member 36 is operatively connected to the human 12 via straps 28, 32 engaging the belt 44 worn by the human, though other techniques for connecting the stock support member 36 to the human 12 may be employed within the scope of the disclosure.

The method further includes operatively connecting the harness member 48 to the human 12, such as by connecting the clips (shown at 54 in FIG. 1) to the human's clothing or another harness or strap connected to the human 12. The method also includes supporting the stock 60 of the firearm 56 on a surface; in the embodiment depicted, the surface is formed by the stock support member 36, as shown in FIG. 6. It should be noted that the harness may be used without the stock support 36 when the human 12 is crouched or sitting. In such a case, the stock 60 will be placed directly on another surface such as the ground in front of the user 12. Accordingly, depending on the intended use, the stock support assembly 24 may be optional.

The method further includes engaging the first fastening element 52 with the second fastening element 86 such that the firearm 56 is supported solely by the fastening elements 52, 86 and the stock support member 36 in a carrying position, as shown in FIG. 6. In the carrying position, the firearm 56 is between horizontal and vertical with respect to the ground; for example, the firearm 56 may be between 35 degrees and 75 degrees from horizontal. In the embodiment depicted, the firearm 56 in the carrying position is much closer to vertical than horizontal.

Referring specifically to FIG. 7, engaging the first fastening element 52 with the second fastening element 86 includes inserting the rod 122 of the first fastening element 52 into the hole 94 of the second fastening element 86 through the end 98 that generally faces the direction of the stock 60. The rod 122 remains in the hole 94 due to friction. More specifically, gravity exerts a force 134 on the firearm 56 that is vertically downward. The surface of member 90, which defines the hole 94, transfers a portion of this force onto the rod 122, including a component 138 that is normal to the surface defining the hole 94. The rod 122 exerts a reaction force on the surface defining the hole 94 having a component 142 that is equal and opposite component 138. The components 138, 142 are of sufficient magnitude that friction between the rod 122 and the member 90 prevents the rod 122 from falling out of the hole 94, thus keeping the fastening elements 52, 86 engaged with one another; accordingly, the fastening elements 52, 86 retain the firearm 56 in its carrying position as shown in FIG. 6.

The first and second fastening elements 52, 86 define a latching system that automatically releases the firearm 56 from the harness system 10 when the firearm 56 is moved to its firing position, thereby minimizing or eliminating any interference with the use of the firearm 56 by the harness system 10. Referring again to FIGS. 6 and 7, to move the firearm 56 to its firing position, the human 12 lifts the firearm 56 from the stock support member 36 and rotates the firearm 56 so that the muzzle 74 is lowered and the stock 60 is raised. In performing this step, the human 12 supports the firearm 56 with hands and arms so that the gravitational force on the firearm 56 is transferred to the human, rather than through the member 90 to the rod 122, and the friction between the rod 122 and the member 90 decreases such that the rod 122 is easily removed from the hole 94, which occurs automatically as the firearm 56 is moved to its firing position, as shown in FIG. 8.

Referring to FIG. 8, wherein like reference numbers refer to like components from FIGS. 1-7, when the firearm 56 is in its firing position, the firearm 56 is generally horizontal and the stock 60 abuts the shoulder of the human 12, as shown in FIG. 8.

Figure 9:
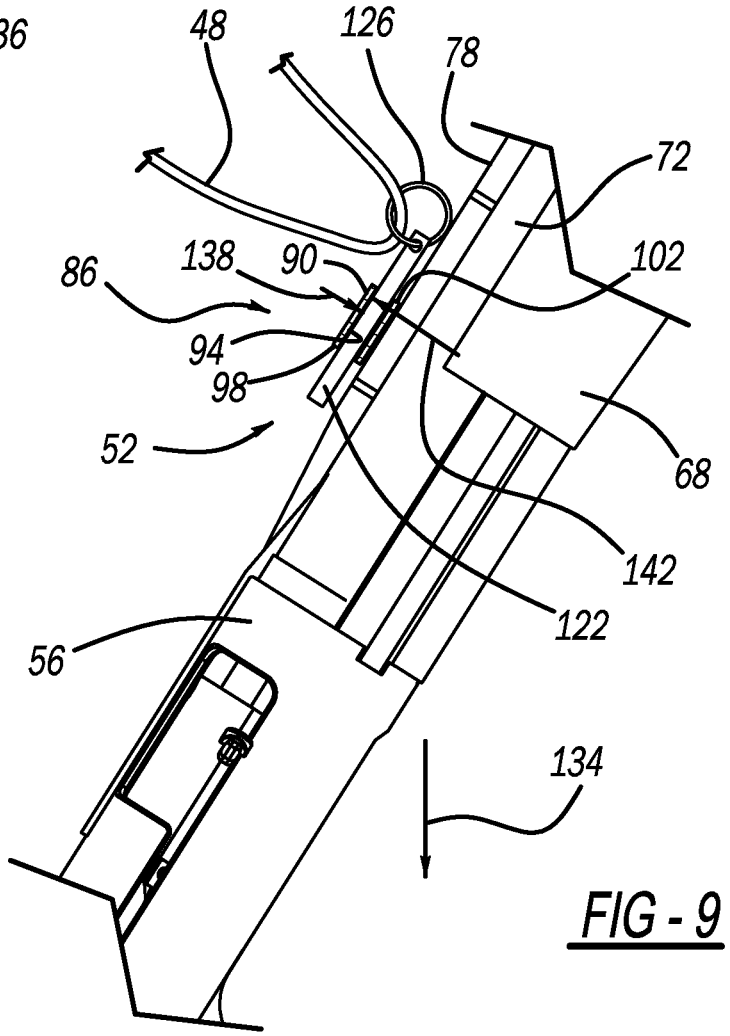
FIG. 9 is a schematic, partial cut-away perspective view of the fastening elements engaged with each other in a mode of operation that prevents automatic disengagement.

The first and second fastening elements 52, 86 provide a mode of operation in which they are not automatically disengageable, and thereby provide a more secure arrangement for carrying the firearm 56 when a rapid movement to the firing position is not needed. More specifically, and with reference to FIG. 9, wherein like reference numbers refer to like components from FIGS. 1-8, the mode of operation in which fastening elements 52, 86 are not automatically disengageable by movement of the firearm 56 to its firing position is achieved by inserting the rod 122 into the hole 94 from end 102. Interference between the ring 126, which is larger than hole 94, and the member 90 prevents the rod 122 from falling out of the hole 94. Furthermore, movement of the firearm to the firing position does not release the rod 122 from the hole 94 because the firearm 56 will be moved in the direction faced by end 102. To disengage the fastening elements 52, 86, the human user must manually remove the rod 122 from the hole 94.

Accordingly, the harness system 10 and the method of use disclosed herein permits hands-free holding of a long gun such as the firearm shown at 56. The harness system 10 allows the user to use his or her hands for blowing duck calls, drinking coffee, staying warm inside pockets, etc. while keeping the gun ready. The harness system 10 improves upon the prior art by safely and securely carrying or holding the firearm 56 in front of the user with the muzzle pointing upward, thereby reducing the time and movement necessary to bring the firearm to a firing position. The harness system 10 also includes a latching system that automatically releases the gun from the harness system when it is moved to its firing position, thereby minimizing or eliminating any interference with the use of the gun by the harness system.

It should be noted that, within the scope of the claimed invention, the rod 122 may be mounted to the firearm 56 and the member 90 defining a hole 94 may be connected to the harness member 48, It should be also be noted that other fastening elements that accomplish the functionality described herein may be employed within the scope of the claims. It should also be noted that pin or rod 122 and hole 94 may have any cross-sectional shape within the scope of the claimed invention.

Those skilled in the art will recognize a variety of materials that may be used to form the stock support member 36 within the scope of the claimed invention. For example, in one embodiment, the stock support member 36 is a flexible fabric in the shape of an upwardly-open pocket to provide lateral stability to the stock 60. In certain uses, the ground or another surface in front of the user may be considered a stock support member within the scope of the claims.

While the best modes for carrying out the disclosure have been described in detail, those familiar with the art to which this disclosure relates will recognize various alternative designs and embodiments for practicing the disclosure within the scope of the appended claims.

The invention claimed is:

1. A method comprising:

attaching a flexible harness member to a human body, said flexible harness member having a first fastening element operatively connected thereto;

possessing a firearm including a stock and a barrel with a muzzle, and having a second fastening element operatively connected thereto, said second fastening element being engageable with the first fastening element;

supporting the stock of the firearm on a surface;

positioning the firearm in a first position such that the muzzle is elevated relative to the stock; and engaging the first fastening element with the second fastening element such that the firearm is supported and retained in the first position only by the fastening elements and the surface;

wherein the first and second fastening elements are configured such that they automatically disengage from each other during movement of the firearm from its first position to a second position in which the stock abuts the shoulder of the human and the firearm is generally horizontal.

2. The method of claim 1, further comprising moving the firearm to the second position.

3. The method of claim 1, further comprising operatively connecting a stock support member to the human, and wherein the stock support member defines the surface.

4. The method of claim 1, wherein the first fastening element includes one of a pin and a member defining a hole; wherein the second fastening element includes the other of a pin and a member defining a hole; and wherein said engaging the first fastening element with the second fastening element includes inserting the pin through the hole.

5. The method of claim 4, wherein the hole is open at a first end and a second end;

wherein the first end faces generally rearward;

wherein the second end faces generally forward; and wherein the method includes inserting the pin into the hole through the first end.

6. The method of claim 5, further comprising inserting the pin into the hole through the second end to achieve a mode of operation in which the first and second fastening elements do not automatically disengage.

7. A system for supporting a firearm, the system comprising:

a first fastening element;

a flexible harness member operatively connected to the first fastening element and mountable with respect to a human user;

a firearm including a stock and a barrel having a muzzle;

a second fastening element operatively connected to the firearm and engageable with the first fastening element; and a stock support member;

wherein the system is configured such that the firearm is supportable solely by the first and second fastening elements and the stock support member when the harness member is mounted with respect to the human user, the first and second fastening elements are engaged with each other, and the firearm is in a first position in which the muzzle is elevated relative to the stock; and wherein the first and second fastening elements are configured to automatically disengage during movement of the firearm from the first position to a second position in which the firearm is generally horizontal and the stock abuts the human's shoulder.

8. The system of claim 7, wherein the first fastening element is one of a pin and a member defining a hole;

wherein the second fastening element is the other of the pin and the member defining a hole; and wherein the pin is insertable into the hole.

* * * * *